United States Patent [19]

Shaikh

[11] 4,341,361

[45] Jul. 27, 1982

[54] YARN CARRIER FOR PRESSURE KIER

[75] Inventor: Humayun N. Shaikh, London, England

[73] Assignee: Burke Mills, Inc., Valdese, N.C.

[21] Appl. No.: 192,717

[22] Filed: Oct. 1, 1980

[51] Int. Cl.[3] ..... B65H 49/02; D06F 17/02

[52] U.S. Cl. ..... 245/130.4; 68/189

[58] Field of Search ..... 242/130.4, 138, 139; 68/189, 198, 199; 8/154, 155, 155.1, 155.2, 157; 126/369, 376–378

[56] References Cited

U.S. PATENT DOCUMENTS

| | | | |
|---|---|---|---|
| 966,877 | 8/1910 | Williamson | 242/139 |
| 3,692,464 | 9/1972 | Furness | 8/149.1 |

*Primary Examiner*—Leonard D. Christian

*Attorney, Agent, or Firm*—W. Thad Adams, III

[57] ABSTRACT

An improved yarn package carrier for supporting packages of yarn in a pressure kier. The improved yarn package carrier comprises a circular base for being positioned within the kier adjacent its bottom and having an upper surface. The spindles are mounted on the upper surface of the yarn carrier base and have progressively greater pre-determined lengths so as to extend upwardly in tiers to a point above the top opening of the kier and into the area defined by and enclosed within the dome-shaped cover into close proximity thereto from its edge to its apex. As a result, the capacity of the kier is greatly increased by enabling as many yarn packages to be carried by the spindles as can be mounted on each spindle intermediate the upper surface of the carrier base and the inner wall of the dome-shaped cover.

6 Claims, 3 Drawing Figures

YARN CARRIER FOR PRESSURE KIER

BACKGROUND OF THE INVENTION

This invention relates to an improved yarn package carrier of the type used to support numerous packages of yarn in vertically-spaced relation on a plurality of upright spindles within a pressure kier. Pressure kiers typically have cylindrical side walls and a dome-shaped cover to seal closed the top opening. The kier must be able to withstand high internal pressures. As a result, the kier cover is dome-shaped to disperse the pressure within the kier more evenly and to more easily withstand the stress on its structural parts.

Pressure kiers are very commonly used to package dye yarns manufactured of various synthetic as well as natural fibers, and are almost indispensible in the dyeing of large, tightly wound packages of nylon and orlon, among others.

While dyeing with a combination of high pressure and heat is still the best means of applying a high quality dye to these types of yarns and fibers, the greatly increasing cost of energy and hydrocarbon-derived dyestuffs necessitates a more effective and efficient means of carrying out these processes. Even though the various dyeing equipment manufacturers can be expected eventually to develop new and much more efficient dyeing machinery, there exists a vast quantity and variety of older and relatively inefficient equipment in place which still has many years of useful life left but is becoming increasingly expensive to operate because of the greatly increasing cost of energy and dyestuffs.

It has been observed that all dome-covered pressure kiers, even those with very high pitched domes, are provided with yarn carriers, the spindles of which are all the same length and carry the same number of yarn packages. Invariably, these spindles extend to below or just even with the top opening of the kier. As a result, the area enclosed within the dome-shaped cover constitutes a large amount of essentially wasted space, since, while it must be filled with extremely hot water or air, it is not contributing to the productivity and efficiency of the kier. Furthermore, while it has not been heretofore recognized, it appears that the unoccupied space enclosed within the dome-shaped cover of a pressure kier contributes to poor quality dyeing by permitting foam to accumulate in the top of the kier, resulting in light or faded spots in the yarn packages carried near the top of the yarn carrier spindles.

SUMMARY OF THE INVENTION

Accordingly, it is an object of this invention to provide an improved yarn package carrier of the type used to support numerous packages of yarn in vertically-spaced relation on a plurality of upright spindles within a top opening, pressure dyeing apparatus such as a pressure kier.

It is a further object of this invention to provide an improved yarn package carrier with a greatly increased yarn package capacity, thereby enabling greatly increased efficiency in the consumption of energy and dyeing chemcials.

It is yet another object of this invention to provide an improved yarn package carrier which reduces the incidence of second-quality yarn by preventing the development and accumulation of foam in the dome-shaped cover of the pressure kier, thus avoiding light and faded spots on the upper yarn packages.

These and other objects and advantages of the present invention are achieved in the preferred embodiment set forth below by providing an improved yarn package carrier of the type used to support numerous packages of yarn in vertically-spaced relation on a plurality of upright spindles within a top opening, pressure dyeing apparatus having cylindrical side walls and a dome-shaped cover cooperating therewith to sealingly close the opening. The improved yarn package carrier comprises a circular base which is positioned within the dyeing apparatus adjacent its bottom. The carrier has an upper surface with a plurality of spindles mounted thereon perpendicular thereto. The spindles have progressively greater, pre-determined lengths so as to extend upwardly in tiers to a point above the top opening of the dyeing apparatus and into the area defined by and enclosed within the dome-shaped cover into close proximity thereto from its edge to its apex. As a result, the capacity of the dyeing apparatus is increased by enabling as many yarn packages to be carried by the spindles as can be mounted on each spindle intermediate the upper surface of the carrier base and the inner wall of the dome-shaped cover.

According to a preferred embodiment of the invention, a standard yarn carrier having 54 spindles, each spindle being 30.25 inches (76.8 cm.) in length and accommodating 8 packages, is modified by replacing these spindles with eighteen, 32-inch (81.2 cm.) and eighteen, 34-inch (86.4 cm.) spindles, each holding 9 yarn packages; twelve, 36-inch (91.4 cm.) spindles, each holding 10 yarn packages; and six, 37.5-inch (95 cm.) spindles, each holding 11 yarn packages. Therefore, a 54-spindle yarn carrier which previously held 432 yarn packages can now accommodate 510 packages within the same pressure kier. The improved yarn carrier, when loaded with yarn packages, gives a "wedding cake" effect. It is apparent when viewing the improved yarn carrier that the yarn packages extend upwardly towards the center of the yarn carrier and well into the area enclosed by the dome-shaped cover when in its closed position.

BRIEF DESCRIPTION OF THE DRAWINGS

Some of the objects and advantages of the invention have been set forth above. Other objects and advantages will appear as the description of the invention proceeds, when taken in conjunction with the following drawings, in which.

DESCRIPTION OF THE PREFERRED EMBODIMENT

Figure 3:
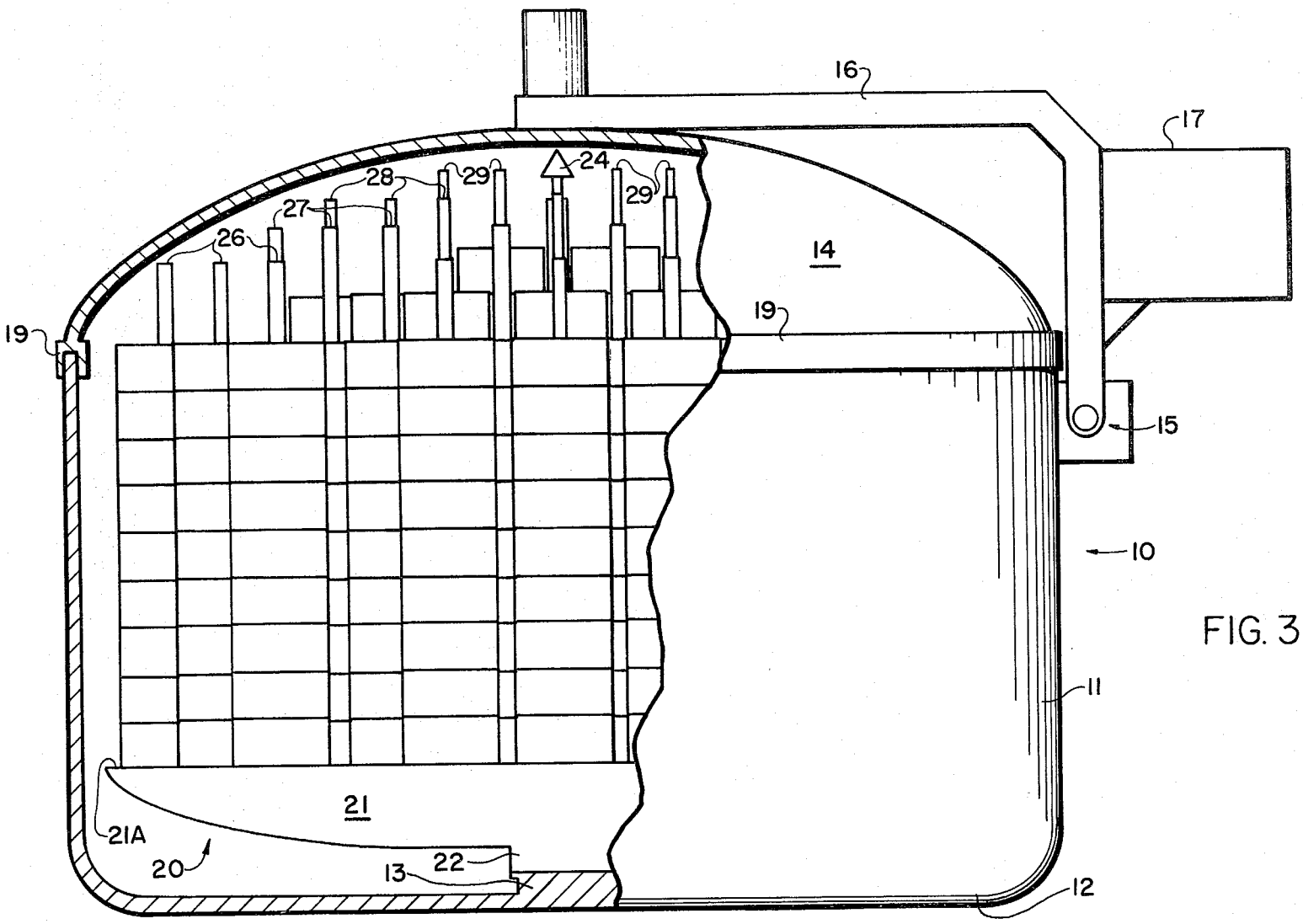

Referring now specifically to the drawings, a pressure kier of a conventional type used in accordance with the present invention is illustrated in a simplified, representational form by broad reference numeral 10 in FIG. 3. The body of the kier is defined by cylindrical side walls 11, a bottom 12, and a circular top opening defined by the terminus of the cylindrical side walls 11.

A platform 13 is positioned concentrically in the bottom of the kier 10 as a support for the yarn carrier.

Still referring to FIG. 3, a dome-shaped cover 14 is shown in partial cross-section in close sealing engagement with the top opening of the kier 10. The cover 14 is hingedly secured to the kier 10 by hinge 15 and brace 16. A counterweight 17 is provided in order to provide a mechanical advantage in opening and closing the cover 14. An enlarged, downwardly facing U-shaped lip 19 is provided around the outer edge of the cover 14 for sealingly engaging the top opening of the kier 10 during the pressure dyeing cycle.

Positioned within the kier 10 is an improved yarn package carrier indicated at broad reference numeral 20. The carrier 20 is comprised of a circular base 21 having an upper, substantially planar surface 21*a*. The base includes a circular, concentric pedestal 22 on the bottom, downwardly facing surface of the base 21, as is shown in FIG. 3. The pedestal 22 provides a secure platform on which the base 21 can rest, and spaces the body of the base 21 a sufficiently great distance from the bottom 12 of the kier 10 so that free circulation of the dye liquor is facilitated.

Figure 2:
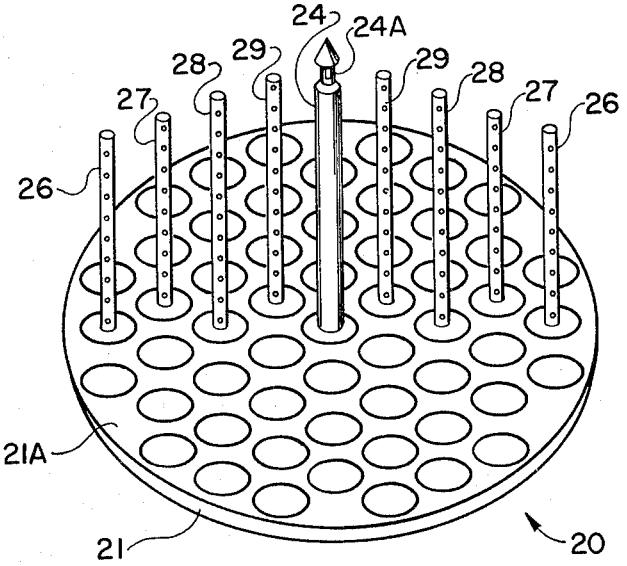
FIG. 2 is a perspective view of the improved yarn carrier according to the present invention with most of the spindles removed for clarity in order to illustrate the progressive lengthening of the spindles towards the center of the yarn carrier; and, FIG. 3 is a fragmentary, cross-sectional view of a conventional pressure kier in closed position, showing the improved yarn package carrier in accordance with the present invention positioned therein.

The yarn carrier 20, especially when fully loaded with yarn packages, is extremely heavy. To facilitate movement of the yarn carrier 20 into and out of the kier 10, an elongate, upwardly extending handle 24 is securely fastened to the center of the yarn carrier base 21, as is shown in FIG. 2. Handle 24 is provided with a through slot 24*a* in the upwardly extending free end of the handle, through which a hook can be passed. Typically, the yarn carrier 10 is moved by means of an overhead electric hoist.

One of the problems encountered in the reduction to practice of the improved yarn package carrier 20 has been the wide variety of shapes and sizes of kiers presently being used. Even among kiers of the same general size, internal dimensions dimensions and proportions vary as does the degree of curvature of the dome-shaped cover. The specific preferred embodiment of the invention which is described herein involves the modification of a conventional yarn carrier having an outside diameter of 65 inches (165 cm.), and intended to fit within a Gaston County Dyeing Machine Company kier having an inside diameter of 67.25 inches (170.8 cm.), a pot depth of 32.5 inches (82.5 cm.) and a dome apex of 19 inches (48.3 cm.) from the cover lip.

While one specific preferred embodiment is disclosed herein, the invention is susceptible of application in any size or proportion of kier. Adaptation to other size kiers involves primarily a determination of the extent to which the spindles of the yarn carrier can be lengthened and/or repositioned to accommodate a greater number of yarn packages, while still permitting the cover of the kier to be closed and properly locked. As experimentation has shown, the modification described herein is most efficient when dyeing yarn packages called "muffs" or other packages having a relatively short height, since these packages provide smaller incremental increases in the distance required on each spindle to accommodate a given number of yarn packages. As FIG. 3 illustrates, a greater percentage of the space enclosed within the dome-shaped cover 14 of the kier 10 can be filled when dyeing packages having a relatively short height.

Figure 1:
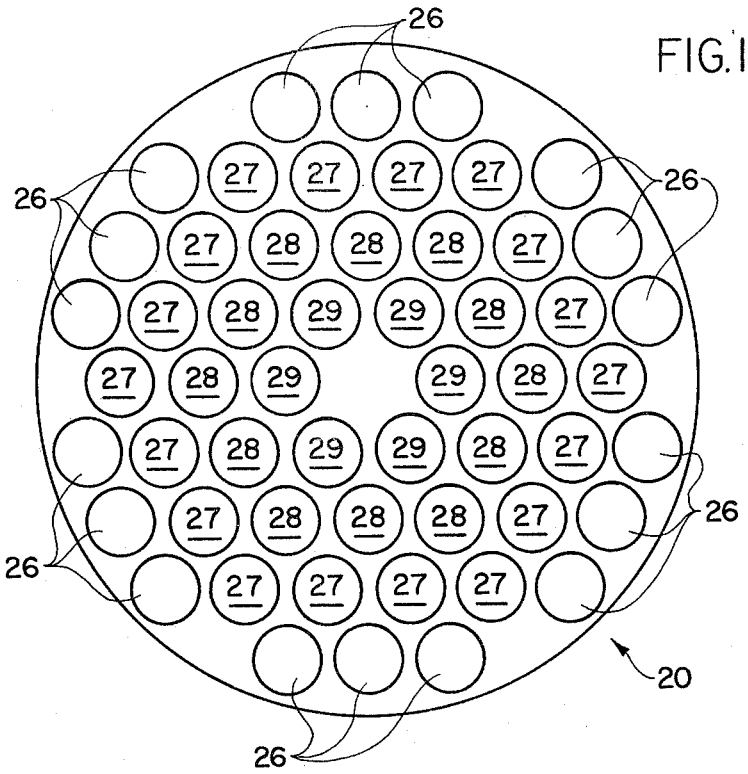
FIG. 1 is a schematic, top plan view of the spindle layout on the improved yarn carrier in accordance with a preferred embodiment of the invention.

Referring to FIG. 1, a top plan view of the spindle layout on the improved yarn carrier is shown. In its conventional form with 54 spindles, each having a length of 30.25 inches (76.8 cm.) the carrier will accommodate eight one-pound "muffs" per spindle for a total of 432 "muffs" per carrier. On the 65-inch (165 cm.) carrier base described, the spindles have a lateral spacing of no less than seven inches (17.8 cm.).

In accordance with the present invention, each of the 54 spindles have been replaced with lengthened spindles as follows:

- 18 spindles, each 32 inches (81.2 cm.) in length (reference numeral 26)
- 18 spindles, each 34 inches (86.4 cm.) in length (reference numeral 27)
- 12 spindles, each 36 inches (91.4 cm.) in length (reference numeral 28)
- 6 spindles, each 37.5 inches (95 cm.) in length (reference numeral 29)

As is shown in FIG. 1, the eighteen outer spindles 26 are positioned in groups of three around the outer peripheral edge of the upper surface 21*a* of yarn carrier base 21. Spindles 27 are positioned around the upper surface 21*a* of the yarn carrier base 21 just inboard of the spindles 26. A space of approximately 2 inches (5.08 cm.) is allowed between the cover 14 and the top of the longest spindles 29.

Spindles 28 are likewise positioned in uniformly spaced-apart relation on the upper surface of yarn carrier base 21*a* just inboard of spindles 27. Finally, the six spindles 29 are positioned in uniform spaced relation immediately around the carrier handle 24.

As shown in FIG. 1, each of the four tiers of spindles (26, 27, 28, and 29) are arranged on the upper surface 21*a* of the yarn carrier 20 in the form of hexagons, as in many conventional kiers. Thus, only the length of the spindles, and not the spacing between spindles, has been modified in this embodiment of the invention.

The spindles in accordance with the above-described embodiment of this invention accommodate conventional one-pound yarn muffs as follows:

- Spindles 26 and 27 (36 spindles total) each accommodate 9 yarn packages;
- Spindles 28 (12 spindles total) each accommodate 10 spindles; and,
- Spindles 29 (6 spindles total) each accommodate 11 yarn packages.

The number of different lengths selected for the various groups of spindles will vary greatly depending on kier size, the shape and curvature of the dome-shpaed cover, and many other variables. As noted above, the spindles in the preferred embodiment of the invention are four different lengths, notwithstanding the fact that only three different numbers of yarn packages (9 packages, 10 packages, and 11 packages) are placed on the spindles. However, with different size packages the difference in length can be important. Moreover, in accordance with the present invention the spindles should be extended to within approximately two inches of the cover 14, regardless of the particular size of the package which might be accommodated thereon. In individual instances where an additional package could be placed on each spindle with only a very slight increase in length, the spindles may be extended closer than two inches to the cover 14.

Thus, the yarn carrier 20, as modified, will now accommodate 510, one-pound yarn packages, whereas prior to the modification, it would accommodate only 432.

The stairstep, or tiered, configuration of the modified spindles is shown representationally in FIG. 2. A more complete view of the modified yarn carrier is shown in FIG. 3.

By increasing the yarn carrier capacity from 432 to 510 yarn packages, capacity of the kier is increased approximately 20% without the necessity of purchasing new equipment or carrying out any substantial and expensive modifications to the kier itself.

However, it has been learned that additional increases in capacity can be obtained by increasing the space between each spindle in order to accommodate larger packages. Of course, this means reducing the number of spindles on the yarn carrier. By increasing the length of the spindles in accordance with the present invention, increases in kier capacity of approximately 35% are possible. For example, the spacing between spindles on a conventional yarn carrier can be increased from 7 inches (17.8 cm.) to 8.5 inches (21.6 cm.). The number of spindles is thereby reduced from 54 to 41. With a spacing of 8.5 inches (21.6 cm.) between spindles, larger, 1.5 pound (0.68 Kg.) packages can be accommodated on the yarn carrier. The spindles, when arranged according to this modification, are spaced with 20 spindles around the periphery of the yarn carrier, 14 spindles immediately inboard of the 20 outer spindles and 7 spindles in closely circling relation to the handle of the yarn carrier. As in the preferred embodiment illustrated in the drawings, the outer 20 spindles each carry 9 yarn packages. The innermost 7 packages are lengthened to accommodate 11 yarn packages. The 14 intermediate spindles each carry 10 yarn packages, therefore, the 41 spindles, lengthened in accordance with this invention, will now accommodate 397 packages, each package weighing 1.5 pounds (0.68 Kg.). Therefore, the number of packages accommodated by the yarn carrier is increased from 328 to 397 by extending the spindles upwardly into the area enclosed by the dome-shaped cover of the kier.

The modifications described and/or illustrated above are sufficient to demonstrate the fundamental concept of this invention—that yarn capacity can be increased and dyeing quality improved without extensive modification by increasing the length of spindles within the kier to extend upwardly into the area enclosed by the dome-shaped cover and to therefore accommodate more yarn packages. Given the extremely wide variety of kier shapes and capacities, the exact length by which the spindles can be lengthened is a matter of measurement and calculation in each separate instance. As described above, the only modification usually required is to the length of the spindles on the yarn carrier 20. However, there may be instances in individual cases where a slight lowering of the platform on which the yarn carrier rests within the kier will enable some or all of the extended spindles to accommodate one additional yarn package each.

The greatest cost savings have been realized in the dyeing of stretch nylon, which requires expensive dye types and long dyeing cycles. For example, dyeing stretch nylon in a kier using a conventional yarn carrier costs approximately 0.696 dollars per pound (1.53 dollars per Kg.), whereas dyeing costs using a modified yarn carrier have extended spindles in accordance with the present invention, a cost per pound of 0.586 dollars (1.28 dollars per Kg.) was achieved for a savings of 11 cents per pound (0.24 dollars per Kg.). This saving is a result of a combination of factors. First, there is a direct saving in the quantity of dye used per pound of yarn. This results because the same amount of water and dye are used in both cases. Since the yarn carrier according to this invention carries more yarn, the cost of dye per pound of yarn dyed is reduced. Since the same amount of dye liquor is used to dye more yarn, a direct saving also results in that the amount of energy required to raise the quantity of dye liquor necessary to dye one package of yarn is reduced. As the cost of primary energy and petroleum-derived dyestuff increases, the savings realized for the above reasons can be expected to increase accordingly. By modifying yarn carriers in accordance with this invention, dyers will find it possible to attain substantial savings in dyeing costs without an offsetting expenditure for new equipment. Yarn carriers have been modified according to this invention at a cost of approximately $5.00 per spindle or approximately $270 per 54-spindle carrier. If spindles are also respaced from 7 to 8.5 inches in order to accommodate larger yarn packages, the cost of the modification per spindle is somewhat greater. In either case, the cost of these modifications, in view of the savings attained, is a very small fraction of the cost required to replace older, less efficient kiers with newer and more energy-efficient ones.

A completely unexpected result of the practice of this invention has been a substantial increase in yarn quality. Yarn spotting is and has been a chronic problem in pressure dyeing. Since the presence of light spots on yarn generally exhibits itself in packages positioned near the top of spindles on conventional yarn carriers, it was long ago understood that spotting was caused primarily by incomplete dyeing resulting from the accumulation of foam in the area of the kier enclosed by the cover, and hence having its greatest effect on yarn packages positioned uppermost in the kier.

Numerous solutions have been proposed for this problem. Wetting agents, anti-foaming agents, lengthened dyeing times, elevated dyeing temperatures, and "rest" periods during the dyeing cycle to enable the foam to dissipate have all been only partially successful, and in each case more expensive.

Dyeing yarn packages in accordance with the present invention has resulted in an almost complete elimination of yarn spotting. It is believed that this improvement in yarn quality results from extending the yarn carrier spindles upwardly into the area enclosed by the cover so that yarn packages accommodate this area during the dyeing cycle. With the elimination of the large open area within the kier cover, foam is no longer permitted to accumulate since its rapid circulation over the yarn packages within this area causes the foam to dissipate as quickly as it is generated. As a result of this phenomonen, dyeing cycles and temperatures can be reduced somewhat and anti-foaming agents can be eliminated.

Described above is a preferred embodiment of a modified yarn carrier which greatly reduces the cost of dyeing yarn packages, and, at the same time, greatly increases the quality of the yarn. Various details of the invention as described may be changed without departing from the scope of the invention. Furthermore, the foregoing description if for the purpose of illustration only and not for the purpose of limitation—the invention being defined by the claims.

I claim:

1. An improved yarn package carrier of the type used to support numerous packages of yarn in vertically-spaced relation on a plurality of upright spindles within a pressure dyeing apparatus having cylindrical side walls and a dome-shaped cover cooperating therewith to sealingly close the opening, wherein the improved yarn package carrier comprises:

(a) a circular base for being positioned within the dyeing apparatus adjacent the bottom thereof and having an upper surface; and (b) a plurality of spindles mounted on the upper surface of the base perpendicular thereto and having progressively greater pre-determined lengths so as to extend upwardly in tiers to a point above the opening of the dyeing apparatus and into the area defined by and enclosed within the dome-shaped cover into close proximity thereto from its edge to its apex;

whereby the capacity of the dyeing apparatus is increased by enabling as many yarn packages to be carried by the spindles as can be mounted on each spindle intermediate the upper surface of the carrier base and the inner wall of the dome-shaped cover.

2. An improved yarn package carrier according to claim 1, wherein said spindles comprise at least two different lengths, the shortest length spindles being positioned around the circumference of the base and the longer length spindles being clustered in spaced-apart relation around the central portion of the base.

3. An improved yarn package carrier according to claim 1, wherein said spindles are at least four different lengths, the shortest two lengths of spindles each holding at least nine muff-type yarn packages per spindle, the next longest length spindles each holding ten muff-type yarn packages, and the longest of the spindles each holding 11 muff-type yarn packages.

4. An improved yarn package carrier according to claim 3, and having a minimum of 41 spindles and a maximum of 54 spindles.

5. An improved yarn carrier according to claim 4 wherein the spacing between spindles is no less than 7 inches and no more than 8.5 inches.

6. An improved yarn package carrier of the type used to support numerous packages of yarn in vertically-spaced relation on a plurality of upright spindles within a pressure dyeing apparatus having cylindrical side-walls and a dome-shaped cover cooperating therewith to sealingly close the opening, wherein the improved yarn package carrier comprises:

(a) a circular base for being positioned within the dyeing apparatus adjacent the bottom thereof and having an upper surface; and (b) a plurality of spindles mounted on the upper surface of the base perpendicular to and having at least two different lengths, the shortest length spindles being positioned around the circumference of the base and the longer length spindles being clustered in spaced-apart relation around the central portion of the base so as to extend upwardly in tiers to a point above the opening of the dyeing apparatus and into the area defined by and enclosed within the dome-shaped cover into close proximity thereto from its edge to its apex;

whereby the capacity of the dyeing apparatus is increased by enabling as many yarn packages to be carried by the spindles as can be mounted on each said spindle intermediate the upper surface of the carrier base and the inner wall of the dome-shaped cover.

* * * * *